US009446581B2

(12) United States Patent
Yamasaki

(10) Patent No.: US 9,446,581 B2
(45) Date of Patent: Sep. 20, 2016

(54) INK SUPPLY DEVICE FOR PRINTING MACHINE

(71) Applicant: I. MER CO., LTD., Kyoto-shi (JP)
(72) Inventor: Kenjiro Yamasaki, Kyoto (JP)
(73) Assignee: I. MER CO., LTD., Kyoto-Shi (JP)

( * ) Notice: Subject to any disclaimer, the term of this patent is extended or adjusted under 35 U.S.C. 154(b) by 0 days.

(21) Appl. No.: 14/416,269
(22) PCT Filed: Sep. 16, 2014
(86) PCT No.: PCT/JP2014/074446
§ 371 (c)(1),
(2) Date: Jan. 21, 2015
(87) PCT Pub. No.: WO2015/045967
PCT Pub. Date: Apr. 2, 2015

(65) Prior Publication Data

US 2015/0183212 A1 Jul. 2, 2015

(30) Foreign Application Priority Data

Sep. 25, 2013 (JP) ..... 2013-198222
Sep. 25, 2013 (JP) ..... 2013-198225
Sep. 25, 2013 (JP) ..... 2013-198237

(51) Int. Cl.
*B41F 31/32* (2006.01)
*B41F 31/02* (2006.01)
(Continued)

(52) U.S. Cl.
CPC ..... *B41F 31/32* (2013.01); *B41F 31/14* (2013.01); *B41F 31/307* (2013.01); *B41F 31/36* (2013.01); *B41F 33/0045* (2013.01); *B41P 2231/10* (2013.01)

(58) Field of Classification Search
CPC ..... B41F 33/0045; B41F 33/0036; B41F 33/0027; B41F 31/02; B41F 31/32
See application file for complete search history.

(56) References Cited

U.S. PATENT DOCUMENTS 5,688,217 A * 11/1997 Izume ..... B41F 31/14 492/39
5,967,049 A * 10/1999 Seymour ..... B41F 31/045 101/365

(Continued)

FOREIGN PATENT DOCUMENTS

JP 10-128956 5/1998
JP 2000-141610 5/2000

(Continued)

OTHER PUBLICATIONS

International Search Report for corresponding International Application No. PCT/JP2014/074446, Dec. 16, 2014.

*Primary Examiner* — Blake A Tankersley
*Assistant Examiner* — Leo T Hinze
(74) *Attorney, Agent, or Firm* — Mori & Ward, LLP

(57) ABSTRACT

Provided is an ink supply device for a printing machine which can accurately supply a quantity of ink necessary for acquiring desired concentration while making the fine adjustment of concentration of ink by an operator unnecessary. A control device 34 of the ink supply device includes: a concentration prediction value calculation means 53 which acquires a concentration prediction value when the concentration becomes stable based on concentration measured values of a predetermined number of printed matters; a graph change value calculation means 54 which acquires a graph change value using the concentration prediction value and a concentration target value; and a control graph value calculation means 55 which acquires a control graph value for controlling a rotational angle based on a preset set graph value and the graph change value.

8 Claims, 7 Drawing Sheets

(51) Int. Cl.

| | |
|---|---|
| ***B41F 31/14*** | (2006.01) |
| ***B41F 31/30*** | (2006.01) |
| ***B41F 31/36*** | (2006.01) |
| ***B41F 33/00*** | (2006.01) |

(56) References Cited

U.S. PATENT DOCUMENTS

| | | | | |
|---|---|---|---|---|
| 5,967,050 | A | 10/1999 | Seymour | |
| 6,318,260 | B1 * | 11/2001 | Chu | B41F 31/00 101/365 |
| 6,422,144 | B1 | 7/2002 | Izume | |
| 7,059,247 | B2 * | 6/2006 | Kiyohara | B41F 33/0036 101/365 |
| 2005/0183595 | A1 | 8/2005 | Kiyohara | |

FOREIGN PATENT DOCUMENTS

| | | |
|---|---|---|
| JP | 2003-1799 | 1/2003 |
| JP | 2005-231221 | 9/2005 |
| JP | 2011-73415 | 4/2011 |

* cited by examiner

INK SUPPLY DEVICE FOR PRINTING MACHINE

TECHNICAL FIELD

The present invention relates to an ink supply device for a printing machine, and more particularly to a device which supplies ink to a printing surface through an ink fountain, an ink fountain roller, an ink transfer roller, and a plurality of ink distribution rollers.

BACKGROUND ART

As this type of ink supply device, there has been known an ink supply device where a plurality of ink transfer rollers which are divided in the lengthwise direction of an ink fountain roller which constitutes an ink fountain are arranged adjacent to the ink fountain roller, the respective ink transfer rollers are individually changed over between a transfer position where the ink transfer roller is brought into contact with the ink fountain roller and a non-transfer position where the ink transfer roller is disposed away from the ink fountain roller, and using a control device, ink is transferred by changing over the position of the predetermined ink transfer roller for every transfer timing at predetermined intervals, and a rotational angle of the ink fountain roller from a position where the ink transfer roller is brought into contact with the ink fountain roller to a position where the ink transfer roller is separated from the ink fountain roller is controlled for every ink transfer roller thus controlling a circumferential length of ink transferred to the ink transfer roller from the ink fountain roller (Patent Literature 1 and Patent Literature 2). The above-mentioned control of the rotational angle of the ink fountain roller is performed by controlling a time from a point of time that an instruction of switching the ink transfer roller to a transfer position is outputted to a point of time that an instruction of switching the ink transfer roller to a non-transfer position is outputted.

In such a device, ink ejected to a surface of the ink fountain roller from the inside of the ink fountain is transferred to the ink transfer roller during a period where the ink transfer roller is changed over to the transfer position, and ink transferred to each ink transfer roller is transferred to the ink distribution roller during a period of time that the ink transfer roller is changed over to a non-transfer position. Then, by controlling a circumferential length of ink transferred for every ink transfer roller, a quantity of ink supplied to the ink distribution roller, that is, to a printing surface is controlled for every ink transfer roller.

The reason that a quantity of ink is controlled for every ink transfer roller is that an optimum quantity of ink differs corresponding to the position in the widthwise direction depending on a pattern of a printed matter. That is, a quantity of ink with respect to each ink transfer roller is set corresponding to a pattern area ratio of the printed matter.

A target value of a quantity of ink is expressed by percentage as a "graph value" for every color and for every ink transfer roller, and based on "graph value" which is preliminarily set corresponding to a pattern area ratio of a printed matter, a circumferential length of ink transferred to the ink transfer roller from the ink fountain roller (to be more specific, an ON/OFF time of a switching valve which moves each ink transfer roller) is controlled.

In the above-mentioned ink supply device, when color change is performed at the time of exchanging an original plate, by performing cleaning of the original plate and, thereafter, by supplying ink corresponding to a pattern area after the exchange of the original plate, proper printing can be performed. When a color change is not performed at the time of exchanging an original plate, cleaning may be performed or may not be performed. At the time of performing exchanging of an original plate without accompanying a color change, in both of the case where cleaning of the original plate is performed and the case where cleaning of the original plate is not performed, printing is performed by supplying ink corresponding to a pattern area after the exchange of the original plate.

CITATION LIST

Patent Literature

PTL 1: JP-A-2011-73415
PTL 2: JP-A-2000-141610

SUMMARY OF INVENTION

Technical Problem

The above-mentioned conventional ink supply device for a printing machine is configured to be operated with an output optimum for a printed matter or a printing condition. In an actual operation, however, there are various printed matters and printing conditions. With the use of only the currently available control, such various printed matters and printing conditions cannot be covered, and the fine adjustment by an operator becomes necessary as a final step.

In this case, there exists a drawback that a time for fine adjustment becomes irregular depending on the difference in experience and technique of an operator or the like so that the final concentration of ink differs. There also exists a drawback that proper concentration of ink cannot be acquired even when the fine adjustment is performed and hence, the fine adjustment is frequently repeated.

In the above-mentioned conventional ink supply device, to set the concentration of ink to a proper value at the time of printing, a graph value is adjusted by elevating or lowering the graph value. However, the concentration of ink does not readily become stable at a point of time that the graph value is elevated or lowered. For example, when the graph value is elevated, an ink retention quantity of a roller of a printing machine is gradually increased and the concentration of ink is increased along with the increase of such an ink retention quantity thus also giving rise to a drawback that it takes long time until the concentration of ink becomes stable after the graph value is elevated.

Also when cleaning is not performed at the time of exchanging an original plate without performing a color change, when printing is performed by supplying ink corresponding to a pattern area after the exchange of the original plate in the same manner as the case where cleaning is performed, there also arises a drawback that there is a tendency where it takes long time until the concentration of ink becomes stable.

It is an object of the invention to provide an ink supply device for a printing machine which can overcome the above-mentioned drawbacks, and can accurately supply a quantity of ink necessary for acquiring desired concentration while making the fine adjustment of concentration of ink by an operator unnecessary.

It is another object of the invention to provide an ink supply device for a printing machine which can overcome the above-mentioned drawbacks, and can shorten a time until the concentration of ink becomes stable when a graph value is changed.

It is a still another object of the invention to provide an ink supply device for a printing machine which can overcome the above-mentioned drawbacks, and can make the concentration of ink stable at the time of printing after an original plate is exchanged.

Solution to Problem

An ink supply device for a printing machine according to the invention is an ink supply device where a plurality of ink transfer rollers which are divided in the lengthwise direction of an ink fountain roller which constitutes an ink fountain are arranged adjacent to the ink fountain roller, the respective ink transfer rollers are individually changed over between a transfer position where the ink transfer roller is brought into contact with the ink fountain roller and a non-transfer position where the ink transfer roller is disposed away from the ink fountain roller, and using a control device, based on a graph value set corresponding to a pattern area of a printed matter, ink is transferred by changing over a position of a required ink transfer roller for every transfer timing at predetermined intervals, and a rotational angle of the ink fountain roller from a position where the ink transfer roller is brought into contact with the ink fountain roller to a position where the ink transfer roller is separated from the ink fountain roller is controlled for every ink transfer roller thus controlling a circumferential length of ink transferred to the ink transfer roller from the ink fountain roller, wherein the control device comprises: a concentration prediction value calculation means which acquires a concentration prediction value when the concentration becomes stable based on concentration measured values of a predetermined number of printed matters; a graph change value calculation means which acquires a graph change value using the concentration prediction value and a concentration target value; and a control graph value calculation means which acquires a control graph value for controlling the rotational angle of the required ink fountain roller based on a preset set graph value and the graph change value.

In the conventional ink supply device, a control corresponding to a preset set graph value is performed, and when an acquired concentration value is deviated from a target value, an operator increases or decreases a quantity of ink so as to correct the concentration value. According to the invention, the concentration is automatically corrected by the control device in place of an operation by the operator.

The concentration value is measured with respect to all ink transfer rollers of all ink transfer roller units respectively. The acquired concentration values are inputted to the concentration prediction value calculation means provided to the control device of the ink supply device in the order that the printed matters are printed. In the concentration prediction value calculation means, a concentration prediction value in a state where the concentration is stable is acquired. In the graph change value calculation means, the difference in concentration value is acquired based on the difference between the concentration prediction value and the concentration target value, and a graph change value corresponding to the difference in concentration value is acquired. In the control graph value calculation means, a graph value after a change is acquired as the difference between a preset set graph value and a graph change value, and the graph value after the change is used as a control graph value for controlling a rotational angle.

In this manner, with the use of the control device, the measurement of concentration and the change of a graph value are performed with respect to all ink transfer rollers of the respective transfer roller units. Accordingly, an irregularity between the respective ink transfer rollers of the ink transfer roller unit becomes small and, at the same time, the concentration reaches a target value (an instruction value) within a short time. Accordingly, a quantity of ink necessary for acquiring desired concentration can be accurately supplied while making the fine adjustment of the concentration by an operator unnecessary.

It is desirable that a control graph value be acquired by a following formula.

A prediction value Y at a point of time that the measurement is performed n times is acquired by the following formula, wherein a measurement value at n-th time is Xn, an average value of measurement values of n times is Xa, a standard deviation amounting to n times is σ, a deviation value of a measurement value at n-th time is T, a concentration prediction coefficient is α, a concentration target value is K, a ratio of surplus/shortage of ink is L, a graph change value is Gs, and a graph value correction coefficient is β.

$$Y=Xn+\{T\times|Xn-Xa|\times\alpha\},$$

$$T=\{10\times(Xn-Xa)/\sigma\},$$

$$\sigma^2=\{(X_1-Xa)^2+(X_2-Xa)^2+\ldots+(Xn-Xa)^2\}/n$$

In the above formulae, when n=1 and when the same measurement value is acquired in all measurements performed n times, $$Y=Xn$$

$$L=(Y-K)\times100/K(\%)$$

$$Gs=Gb\times L\times\beta\div100(\%)$$

$$Ga=Gb+Gs$$

α and β may be 1 or a value near 1, for example. A prediction value can be adjusted by changing the value of α, and a graph change value can be adjusted by changing the value of β.

In the above-mentioned control, at the time of changing the graph value to Ga from Gb (Gs=Ga−Gb), the graph value is temporarily set to Gz1, and after a graph change value amounting to predetermined temporary number of cycles is outputted, the graph value Ga is outputted. The temporary graph value Gz1 amounting to 1 cycle is acquired by Gz1=Ga+{(γ×Gs)/ϵ}, wherein γ and ϵ are concentration correction coefficients of natural numbers.

1. When the graph value Gz1 is a positive value and is smaller than a graph change value Gm amounting to 1 circumference of the ink transfer roller, the graph change value Gz1 is acquired by Gz1=Ga+{(γ×Gs)/ϵ} during a period that the temporary number of cycles S is ϵ (S=ϵ).

2. When the graph value Gz1 exceeds the graph change value Gm amounting to 1 circumference of the ink transfer roller, the graph change value Gz1 is set to Gm(Gz1=Gm) during a period that the temporary number of cycles S is expressed by S=(γ×Gs)/(Gm−Ga).

3. When the temporary graph value Gz1 amounting to 1 cycle is a negative value, it is preferable to set the graph change value Gz1 to 0% (Gz1=0%) during a period where the temporary number of cycles S is expressed by S=(γ×Gs)/Ga.

When a graph value is changed, such a change is not reflected on the concentration of ink until an ink retention quantity of the roller is changed. Accordingly, in the conventional control, the concentration of ink is not readily changed, and the concentration of ink arrives at the target concentration with a lapse of a sufficient time. According to the ink supply device for a printing machine of the invention, to make an ink retention quantity of the roller readily change when a graph value is changed, an ink quantity equal to or larger than the difference is rapidly supplied for a fixed time in case of increasing the ink quantity, and an outputting of the ink transfer roller is stopped for a fixed time in case of decreasing the ink quantity. Due to such a control, the time necessary for making the concentration of ink stable when a graph value is changed can be shortened.

Further, in the above-mentioned operation, at the time of exchanging an original plate, a comparison between a pattern area before exchanging the original plate and a pattern area after the exchange of the original plate is performed with respect to all ink transfer rollers. When the pattern area is increased after the exchange of the original plate, additional ink distribution is performed. When the pattern area is decreased after the exchanging the original plate, an operation of the ink transfer roller is stopped for a fixed time. Assuming that the pattern area before exchanging the original plate is A %, a retention ink quantity before exchanging the original plate is Y+AZ %, the pattern area after the exchange of the original plate is B %, a retention ink quantity after the exchange of the original plate is Y+BZ %, it is preferable that the following operation is performed corresponding to whether the difference (B−A)Z (%) before and after the exchange of the original plate takes a positive value or a negative value.

Additional ink distribution is performed Z times in case of (B−A)Z>0.

Ink transfer amounting to (A−B)Z/B times is stopped in case of (B−A)Z<0.

As a cause that it takes long time until color becomes stable at the time of exchanging an original plate, it is considered as follows. When a pattern area of an original plate before exchanging the original plate is large, a quantity of ink retained by a group of rollers (an ink transfer roller and a plurality of ink distribution rollers) is large and hence, the printing concentration of ink is thick and is gradually lowered to stable concentration, while when the pattern area of the original plate before exchanging the original plate is small, a quantity of ink held by the group of rollers is small and hence, the printing concentration of ink is thin and is gradually increased to stable concentration.

Accordingly, a quantity of ink retained by the group of rollers before exchanging the original plate and a quantity of ink necessary for the group of rollers after the exchange of the original plate are compared to each other, ink is additionally supplied temporarily when a quantity of ink after the exchange of the original plate is increased, while the supply of ink is temporarily stopped when a quantity of ink after the exchange of the original plate is decreased so that the time until the concentration of ink arrives at the stable concentration after the exchange of the original plate can be shortened.

To refer a rotational angle of the ink fountain roller from contacting of the ink transfer roller to the ink fountain roller to leaving of the ink transfer roller from the ink fountain roller as "contact rotational angle", the control of the contact rotational angle is performed by controlling the time from a point of time that a switching instruction for changing over the ink transfer roller to a transfer position (contact instruction) is outputted to a point of time that a switching instruction for changing over the ink transfer roller to a non-transfer position (a non-contact instruction) is outputted.

It is considered that ink retained by the ink transfer roller when printing is stable is in a state where ink having the uniform thickness (referred to as Y) over the whole region ranging from one end to the other end of the ink transfer roller, and ink having a thickness proportional to a pattern area of a printed matter (assuming a proportional constant as Z) overlap with each other. Accordingly, assuming that a pattern area before exchanging an original plate is A %, a quantity (%) of ink retained before exchanging the original plate becomes Y+AZ (%), while assuming that the pattern area after the exchange of the original plate is 3%, a quantity (%) of ink retained after the exchange of the original plate becomes Y+BZ (%). Accordingly, the difference between before and after the exchange of the original plate becomes (B−A)Z (%).

There are the case where B>A and the case where B<A and hence, the difference takes either a positive value or a negative value. Here, a different operation is performed corresponding to whether the difference is a positive value or a negative value.

When the difference (B−A)Z is larger than 0 ((B−A)Z>0), additional ink distribution is performed where the number of times of ink distribution is Z which is a proportional number of times. A percentage of ink distribution becomes (B−A) (%). Accordingly, the concentration of ink arrives at the concentration of the instruction value within a short time and hence, it is possible to make the printing concentration of ink stable.

On the other hand, when the difference (B−A)Z is smaller than 0 ((B−A)Z<0), the ink transfer is stopped for a predetermined time. The condition for stopping the ink transfer is that the ink transfer amounting to (A−B)Z/B times is stopped. Accordingly, the concentration of ink arrives at the concentration of the instruction value within a short time and hence, it is possible to make the printing concentration of ink stable.

In this manner, at the time of exchanging an original plate, in both the case where the difference (B−A)Z is larger than 0 ((B−A)Z>0) and the case where the difference (B−A)Z is smaller than 0 ((B−A)Z<0), the concentration of ink arrives at the concentration of the instruction value after the exchange of the original plate within a short time and hence, it is possible to make the printing concentration of ink stable.

When a normal operation where the transfer of ink is performed each time for every transfer timing and an intermittent operation where the number of times of transfer is decreased compared to the normal operation are performed, and B is equal to or less than an intermittent operation percentage and satisfies (B−A)Z<0, it is preferable to stop ink transfer amounting to {(A−B)Z/B}×C/B times.

Due to such a control, even in the case of performing the intermittent operation, the concentration of ink arrives at the concentration of an instruction value after exchanging an original plate within a short time and hence, it is possible to make the printing concentration of ink stable.

Advantageous Effects of Invention

According to the ink supply device for a printing machine of the invention, as described above, a concentration value corresponding to each ink transfer roller is measured, and the measured concentration value is fed back to a control of each ink transfer roller and hence, a quantity of ink necessary for acquiring desired concentration can be accurately supplied without requiring the fine adjustment of concentration by an operator.

Further, as described above, to enable a readily change of an ink retention quantity when a graph value is changed, an ink quantity equal to or larger than the difference is rapidly supplied for a fixed time when a quantity of ink is increased, and outputting of the ink transfer roller is stopped for a fixed time when a quantity of ink is decreased. Due to such a control, the time necessary for making the concentration of ink stable when a graph value is changed can be shortened.

Still further, as described above, a quantity of ink retained in the group of rollers before exchanging an original plate and a quantity of ink necessary for the group of rollers after the exchange of the original plate are compared to each other, and ink is additionally supplied temporarily when a quantity of ink after the exchange of the original plate is increased, and the supply of ink is temporarily stopped when a quantity of ink after the exchange of the original plate is decreased. Due to such an operation, even when the difference before and after the exchange of the original plate takes a positive value or a negative value, the concentration of ink arrives at the concentration of an instruction value after the exchange of the original plate within a short time and hence, it is possible to make the printing concentration of ink stable.

Figure 1:
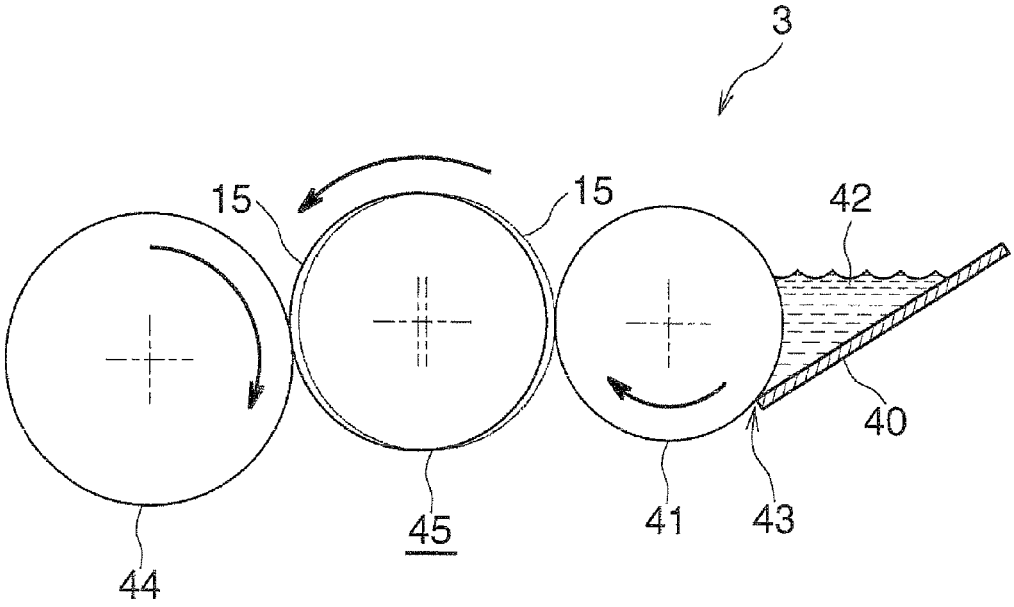
FIG. 1 is a schematic side view of a main part of an ink supply device for a printing machine according to an embodiment of the invention.

REFERENCE SIGNS LIST (1) ink supply device for printing machine
(2) printing machine
(3) ink supply device
(15) ink transfer roller
(34) control device
(41) ink fountain roller
(42) ink fountain
(53) concentration prediction calculation means
(54) graph change value calculation means
(55) control graph value calculation means

DESCRIPTION OF EMBODIMENTS

Hereinafter, an embodiment of the invention is explained by reference to drawings.

Figure 2:
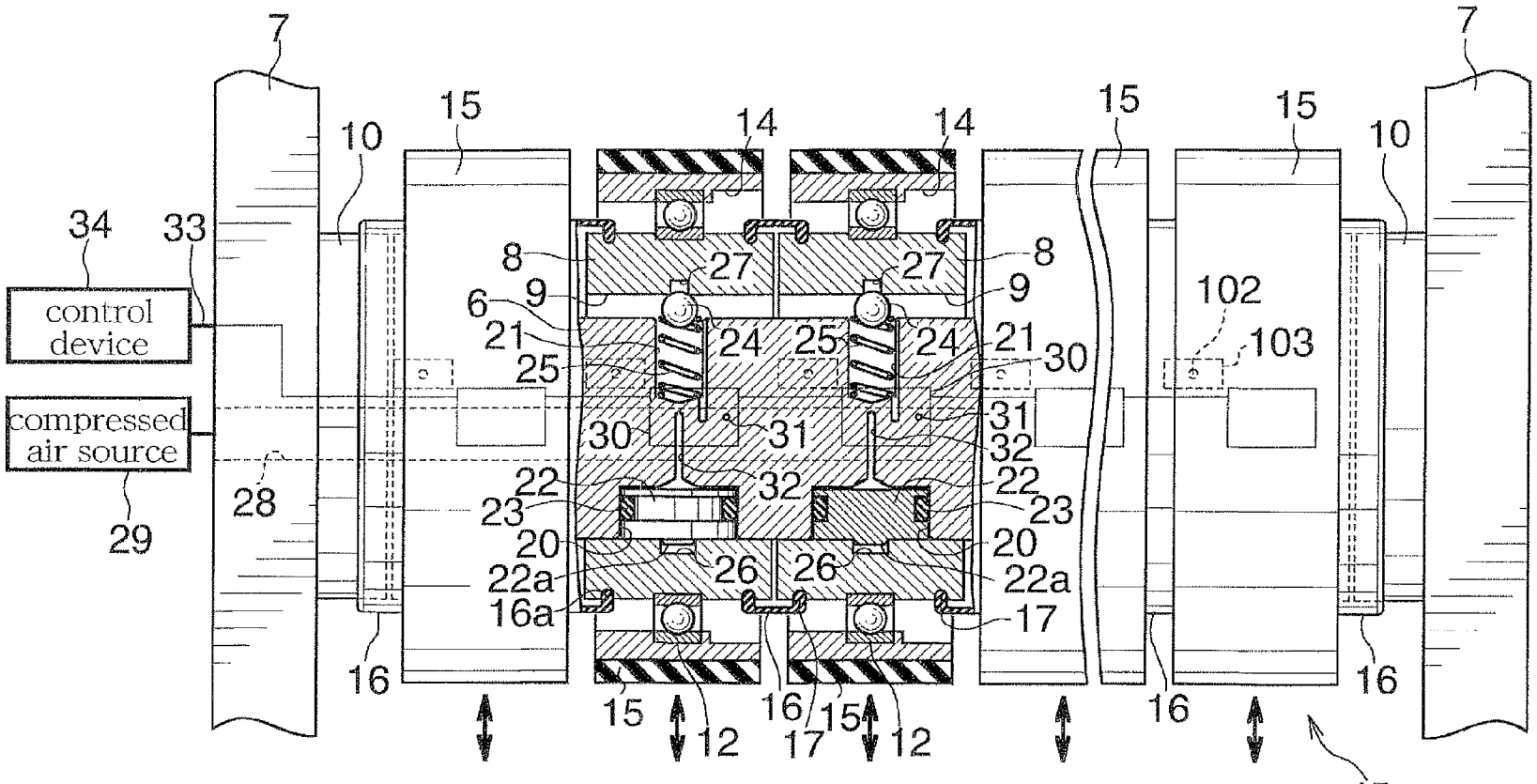
FIG. 2 is a plan view with a part broken away of an ink transfer roller unit shown in FIG. 1.
Figure 3:
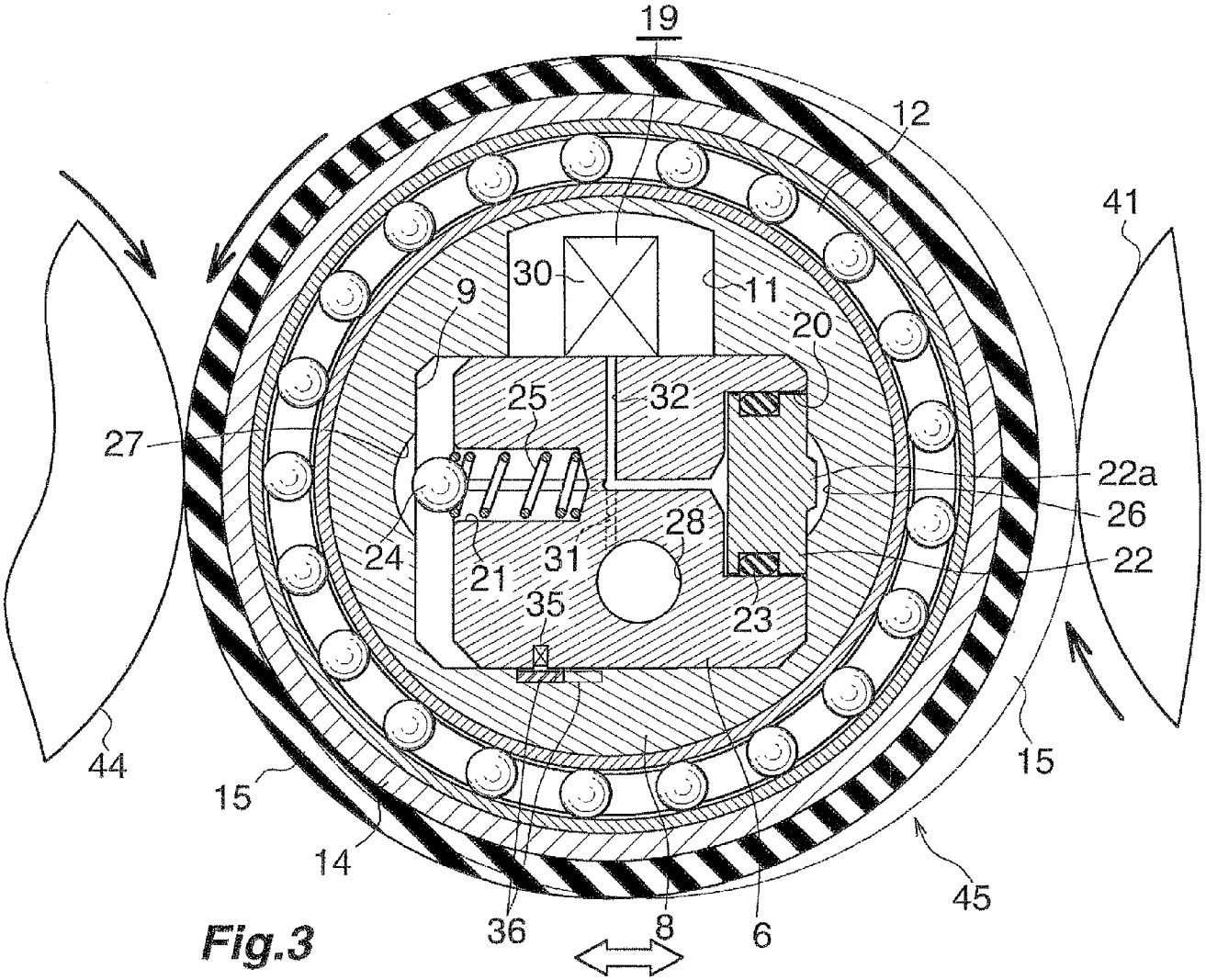
FIG. 3 is a transverse cross-sectional view of FIG. 2.

FIG. 1 is a left side view schematically showing a portion of an ink supply device for a printing machine, FIG. 2 is a plan view with a part broken away showing a portion shown in FIG. 1 in an enlarged manner, and FIG. 3 is an enlarged transverse cross-sectional view of FIG. 2. In the explanation made hereinafter, a right side in FIG. 1 and FIG. 3 (a lower side in FIG. 2) is assumed as a front side, a left side in FIG. 1 and FIG. 3 (an upper side in FIG. 2) is assumed as a rear side, and a left side and a right side when the ink supply device is viewed from a front side are assumed as a left side and a right side of the ink supply device respectively.

As shown in FIG. 1, an ink fountain roller (41) is arranged close to a rear end portion of an ink fountain member (40). An ink fountain (42) is constituted of the ink fountain roller (41) and the ink fountain member (40). An ink passage (43) having a predetermined gap is formed between the rear end portion of the ink fountain member (40) and a front surface of the ink fountain roller (41).

Out of a plurality of ink distribution rollers (44), (46), a first ink distribution roller (44) is arranged behind the ink fountain roller (41). An ink transfer roller unit (45) is arranged between the ink fountain roller (41) and the ink distribution roller (44) in a state where the ink transfer roller unit (45) is arranged close to both the ink fountain roller (41) and the ink distribution roller (44). As shown in FIG. 2, the roller unit (45) is an assembly of a plurality of (seven in the drawing) ink transfer rollers (15) divided in the axial direction of the rollers (41), (44). These ink transfer rollers (15) are arranged at small intervals in the axial direction. An axis of the roller, (15), an axis of the roller (41) and an axis of the roller (44) are arranged parallel to each other, and extend in the lateral direction. The ink fountain roller (41) and the ink distribution roller (44) are rotatably supported on a frame (7) of a printing machine, and are continuously rotated in the direction indicated by an arrow in FIG. 1 respectively at predetermined rotational speeds in synchronism with each other by a driving device not shown in the drawing. For example, the rotational speed of the ink fountain roller (41) is approximately one tenth of the rotational speed of the ink distribution roller (44).

Both left and right end portions of a linear support member (6) extending parallel to the rollers (41), (44) are fixed to the frame (7), and a plurality of movable members (8) are mounted on a peripheral portion of the support member (6). The support member (6) has a rectangular columnar shape where a vertical width is slightly larger than a fore-and-aft width. The movable member (8) has a short circular columnar shape, and a relatively large rectangular-shaped hole (9) is formed in the movable member (8) in an axially penetrating manner. The plurality of movable members (8) are arranged parallel to each other in the axial direction between a pair of short circular columnar-shaped fixing members (10) which are fixed to the frame (7) in an opposedly facing manner and which the support member (6) penetrates. The support member (6) passes through these holes (9) formed in these movable members (8). A vertical width of the hole (9) of the movable member (8) is set substantially equal to a vertical width of the support member (6), and both upper and lower surfaces of the hole (9) are brought into slide contact with both upper and lower surfaces of the support member (6). A longitudinal width of the hole (9) is slightly larger than a longitudinal width of the support member (6) so that the movable member (8) is movable in the longitudinal direction between a front end position where a rear surface of the hole (9) is brought into contact with a rear surface of the support member (6) and a rear end position where a front surface of the hole (9) is brought into contact with a front surface of the support member (6). A rectangular groove (11) is formed on an upper surface of the hole (9) formed in the movable member (8) which is brought into slide contact with the support member (6). The rectangular groove (11) extends over the whole length of the movable member (8).

As described later, the respective movable members (8) are positioned with respect to the support member (6) in the axial direction, and a slight gap is provided between the movable members (8) as well as between the movable members (8) and the fixing member (10) at both ends in the axial direction. Accordingly, the respective movable members (8) can move individually in the longitudinal direction with respect to the support member (6).

An inner race of a ball bearing (12) which is a roller bearing is fixed to an outer periphery of each movable member (8). A metal-made sleeve (14) is fixed to an outer periphery of an outer race of each ball bearing (12), and the rubber-made circular cylindrical ink transfer roller (15) having a large wall thickness is fixed to an outer periphery of the sleeve (14).

A dustproof member (16) having a short circular columnar shape is disposed between and fitted on outer peripheries of neighboring movable members (6). The dustproof member (16) is formed of an appropriate rubber-like elastic material such as natural rubber, synthetic rubber, or a synthetic resin, and a flange portion (16*a*) which slightly projects inwardly is integrally formed on both end portions of the dustproof member (16). The dustproof member (16) is fixed to the movable members (8) in a state where the flange portions (16*a*) of the dustproof member (16) are fitted in annular grooves (17) formed on outer peripheral surfaces of the respective movable members (8) at positions close to both left and right ends of the movable member (8). Substantially same dustproof member (16) is disposed between and fitted on the outer peripheries of the movable members (8) on left and right ends and the outer peripheries of the fixing member (10) arranged adjacent to these movable members (8) on the left and right sides.

A roller position switching device (19) which changes over the position of the ink transfer roller (15) as described below is disposed between each movable member (8) and the support member (6) and also on a support member (6) side.

In a portion of the support member (6) which corresponds to a center portion of the movable member (8) in the axial direction, a cylinder portion (20) is formed by forming a hole which extends slightly rearwardly from a front surface of the support member (6), and a spring accommodating hole (21) which extends slightly frontwardly from a rear surface of the support member (6) is formed. The center of the cylinder portion (20) and the center of the spring accommodating hole (21) are arranged on one longitudinally-extending straight line positioned in the vicinity of the center of the movable member (8) in the vertical direction. A piston (22) having a short circular columnar shape is inserted into the cylinder portion (20) by way of an O ring (23) in a longitudinally slidable manner. A ball (24) which constitutes a biasing member is inserted into the spring accommodating hole (21) in a longitudinally slidable manner, and a compression coil spring (25) which biases the ball (24) in the rearward direction is inserted into the spring accommodating hole (21).

Recessed portions (26), (27) are formed on a front surface of the hole (9) of the movable member (8) which faces the center of the piston (22) in an opposed manner and on a rear surface of the hole (9) of the movable member (8) which faces the center of the ball (24) in an opposed manner respectively. Widths of the respective recessed portions (26), (27) in the axial direction of the movable member (8) are fixed. Cross-sectional shapes of the respective recessed portions (26), (27) in cross section orthogonal to the axial direction of the movable member (8) are uniform, and are formed into an arc shape having the center thereof at a straight line arranged parallel to the above-mentioned axial direction. A tapered projection (22*a*) is formed on the center of an end surface of the piston (22) which faces the recessed portion (26) in an opposed manner, and the projection (22*a*) is fitted in the recessed portion (26). A length of the piston (22) excluding a length of the projection (22*a*) is set slightly shorter than a length of the cylinder portion (20) so that even in a state where the piston (22) enters the inside of the cylinder portion (20) at a maximum, most of the projection (22*a*) projects from a front surface of the support member (6). On the other hand, a portion of the outer periphery of the ball (24) is fitted in the recessed portion (27).

At the rear portion of the support member (6), the ball (24) is always brought into pressure contact with the rear surface of the hole (9) formed in the movable member (8) by a resilient force of the spring (25), and a portion of the outer periphery of the ball (24) is fitted in the recessed portion (27), and is brought into pressure contact with front and rear edge portions of the recessed portion (27). On the other hand, at the front portion of the support member (6), the front surface of the support member (6) or the piston (22) is brought into pressure contact with the front surface of the hole (9) formed in the movable member (8), and most of the projection (22*a*) of the piston (22) is fitted in the recessed portion (26). In this manner, most of the projection (22*a*) of the piston (22) and the portion of the ball (24) are always fitted in the recessed portions (26), (27) respectively as described above and hence, the movable member (8) is positioned with respect to the support member (6) in the axial direction.

An air supply hole (28) having a circular transverse cross-sectional shape is formed in the support member (6) in such a manner that the air supply hole (28) extends in the axial direction from a left end of the support member (6) and is closed at a position in the vicinity of a right end of the support member (6). An opening end of the hole (28) at a left end is connected to a compressed air source (29) through an appropriate pipe.

A switching valve (solenoid valve) (30) is mounted on the upper surface of the support member (6) which faces the groove (11) formed in the movable member (8) in an opposed manner. Two ports of the switching valve (30) are respectively communicated with the air supply hole (28) and the cylinder portion (20) through communication holes (31), (32) formed in the support member (6). An electric wire (33) of the switching valve (30) is led to the outside through a portion of the groove (11), and is connected to a control device (34).

In a state where electricity is supplied to the switching valve (30) (ON state), the cylinder portion (20) is communicated with the air supply port (28) through the switching valve (30). On the other hand, in a state where the supply of electricity to the switching valve (30) is stopped (OFF state), the cylinder portion (20) is communicated with the atmosphere through the switching valve (30). By individually changing over an energizing state of the switching valve (30) of each switching device (19) by the control device (34), the position of each ink transfer roller (15) in the longitudinal direction can be changed over individually.

When a state of the switching valve (30) is changed over to an OFF state, the cylinder portion (20) is communicated with the atmosphere and hence, the piston (22) is brought into a state where the piston (22) is freely movable in the cylinder portion (20). Accordingly, the movable member (8) is moved rearwardly by the spring (25) by way of the ball (24). As a result, the position of the movable member (8) and the position of the ink transfer roller (15) are changed over to the rear end position (non-transfer position). Accordingly, the ink transfer roller (15) is separated from the ink fountain roller (41), and comes into pressure contact with the ink distribution roller (44).

When the state of the switching valve (30) is changed over to an ON state, the cylinder portion (20) is communicated with the air supply hole (28) and, further, is communicated with the compressed air source (29) through the air supply hole (28) and hence, compressed air is supplied to the cylinder portion (20). Accordingly, the piston (22) projects frontwardly from the support member (6) against a force of the spring (25) so that the movable member (8) is moved frontwardly. As a result, the movable member (8) and the ink transfer roller (15) are changed over to the front end position (transfer position), and the ink transfer roller (15) is separated from the ink distribution roller (44), and is brought into pressure contact with the ink fountain roller (41).

A position switching detection sensor (35) which is formed of a magnetic sensor is fixed in an embedded manner to a lower surface of the support member (6) which is brought into slide contact with a bottom wall of the hole (9) of the movable member (8). A permanent magnet (36) is fixed in an embedded manner to a bottom wall of the hole (9) formed in the movable member (8) which faces the lower surface of the support member (6) in an opposed manner. A lower surface of the sensor (35) is positioned coplanar with the lower surface of the support member (6) or is positioned slightly inside (on an upper side of) the lower surface of the support member (6). An upper surface of the permanent magnet (36) is positioned coplanar with the bottom wall surface of the hole (9) of the movable member (8) or is positioned slightly inside (on a lower side of) the bottom wall surface of the hole (9). In a state where the movable member (8) is changed over to the rear end position, the sensor (35) faces a center portion of the permanent magnet (36) in the longitudinal direction. In a state where the movable member (8) is changed over to the front end position, the sensor (35) is separated rearwardly from the permanent magnet (36). Accordingly, an output of the sensor (35) is changed in response to the position of the movable member (8), and the position of the movable member (8), that is, the position of the ink transfer roller (15) can be recognized based on an output of the sensor (35).

Ink in the ink fountain (42) is ejected onto an outer peripheral surface of the ink fountain roller (41) after passing through the ink passage (43). A film thickness of ink ejected onto the surface of the ink fountain roller (41) corresponds to a size of a gap of the ink passage (43). Accordingly, a film thickness of ink ejected to the surface of the ink fountain roller (41) can be adjusted by adjusting a size of the gap of the ink passage (43). Usually, a size of the gap of the ink passage (43) is adjusted such that a film thickness of ink is made uniform with respect to all ink transfer rollers (15). Ink ejected onto the outer peripheral surface of the ink fountain roller (41) is transferred to the ink transfer roller (15) during a time where the ink transfer roller (15) is changed over to the front end position, and the ink transferred to each ink transfer roller (15) is transferred to the ink distribution roller (44) during a time where the ink transfer roller (15) is changed over to the rear end position. Then, as shown in FIG. 3, the ink transferred to the ink distribution roller (44) is supplied to a printing surface through a plurality of other ink distribution rollers (46). Further, it is detected whether or not the switching of the position of the ink transfer roller (15) is normal based on an output of the sensor (35). When the position of the ink transfer roller (15) is not normally changed over, an alarm is generated.

In the above-mentioned printing machine, the control device (34) transfers ink by changing over the position of the desired ink transfer roller (15) for every transfer timing at predetermined intervals, and controls a rotation angle (contact rotation angle) of the ink fountain roller (41) from a time where the ink transfer roller (15) is brought into contact with the ink fountain roller (41) to a time where the ink transfer roller (15) is separated from the ink fountain roller (41) for every ink transfer roller (15) thus controlling a circumferential length of ink to be transferred to the ink transfer roller (15) from the ink fountain roller (41). As a result, a quantity of ink to be supplied to the printing surface is adjusted corresponding to the position of the ink in the widthwise direction of the printing surface.

The control of a contact rotation angle is performed by controlling a time (contact instruction time) from a point of time that an instruction (contact instruction) for changing over the position of the ink transfer roller (15) to a transfer position is outputted to a point of time that an instruction (non-contact instruction) for changing over the position of the ink transfer roller (15) to a non-transfer position is outputted.

When a pattern to be printed is indicated, a pattern area ratio is read using a pattern area reading device. A graph value corresponding to an ink supply quantity is calculated. The graph value is converted into a contact length between the ink transfer roller (15) and the ink fountain roller (41). Then, the contact length is used for the control of the supply of ink described above. The graph value is a target value of an ink quantity indicating a quantity of ink having predetermined color to be used for every ink transfer roller (15). The graph value is expressed by percentage (%). When ink having predetermined color is not used, the graph value of the color is expressed as 0%, and when the ink having predetermined color is used at a maximum, the graph value is expressed as 100%. Accordingly, the graph value can be set to 30%, 40%, 10% or the like corresponding to a pattern area at a portion to which each ink transfer roller (15) corresponds. Based on a graph value expressed by percentage (%), an ink transfer time of the ink transfer roller (15) (a time during which the ink fountain roller (41) and the ink transfer roller (15) are brought into contact with each other, that is, a time during which the switching valve (30) is turned on) is controlled. When the number of colors to be used is eight, eight plate cylinders (eight ink transfer roller units (45)) are used, and a graph value is set for every color (each plate cylinder, that is, the each ink transfer roller unit (45)) and for every ink transfer roller (15).

Ideally, the concentrations of the respective colors are uniform at any positions by performing such a control. However, in an actual operation, the concentration value is different for each ink transfer roller (15). In view of the above, it is preferable to perform the following control. That is, at a portion where the concentration of ink is low, a graph value of each ink transfer roller (15) which supplies ink to the portion is increased, while at a portion where the concentration of ink is high, a graph value of each ink transfer roller which supplies ink to the portion is decreased.

In this embodiment, the concentration values are maintained at proper values by feeding back the concentration values by the control device (34) of the ink supply device as follows.

Figure 4:
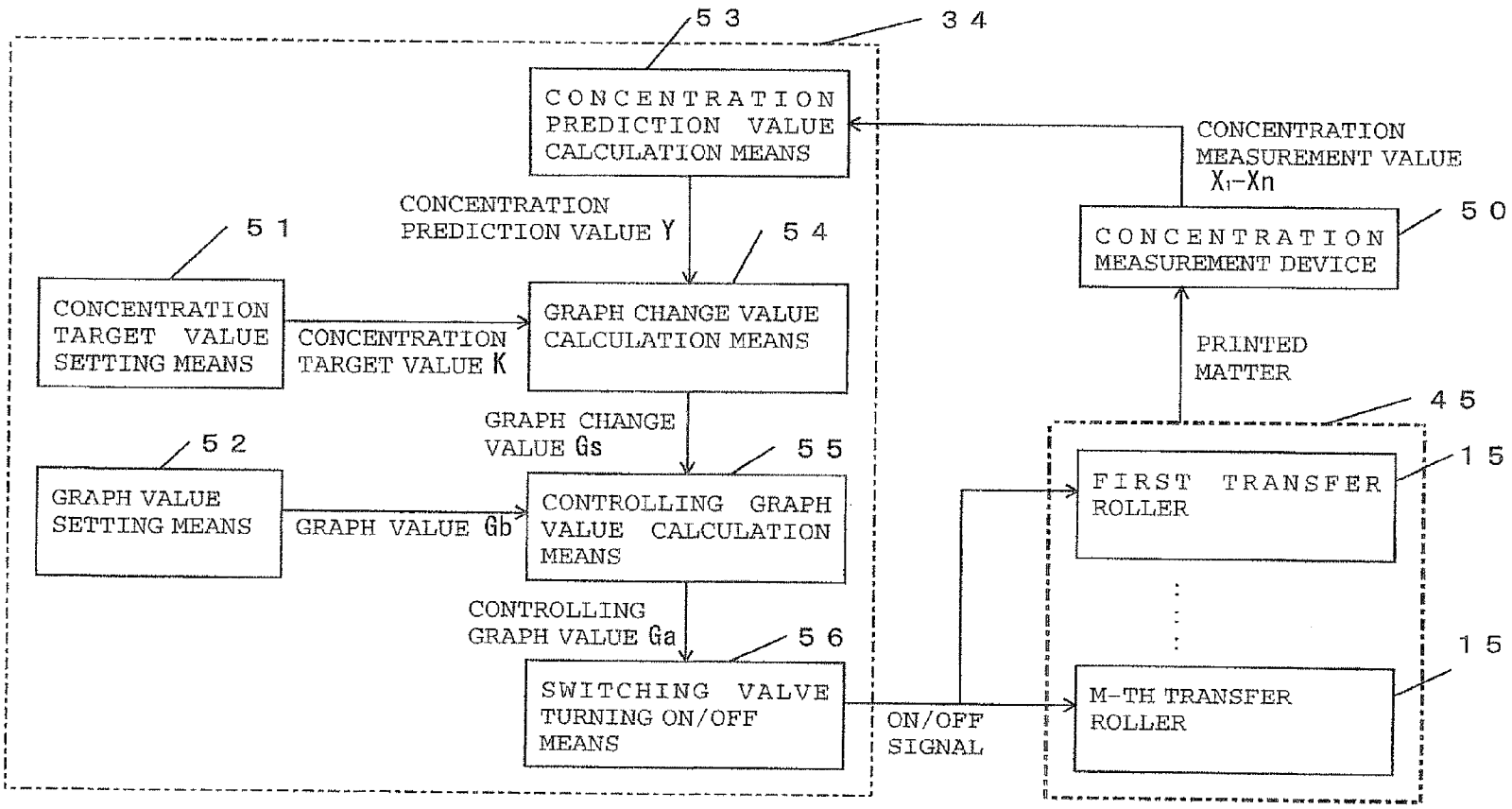
FIG. 4 is a block diagram showing a control device of the ink supply device.

FIG. 4 is a block diagram of the control device (34) of the ink supply device. In FIG. 4, the printing machine includes a concentration measurement device (50) so that the concentration of printed matters is measured by the concentration measurement device (50).

It is sufficient for the measurement of the concentration of ink that a patch for measuring the concentration of ink is mounted on an original plate for printing, and the concentration of ink at a portion corresponding to the patch is measured. As the concentration measurement device (50), a known measurement device may be used. A concentration value can be acquired as an arithmetic mean of RGB (red, green and blue) components at a portion set as a concentration measurement portion. In the above-mentioned ink supply device, a plurality of plate cylinders are used corresponding to a plurality of colors, and the ink transfer roller unit (45) which is an assembly of a plurality of ink transfer rollers (15) is provided corresponding to each plate cylinder. Accordingly, a concentration value is measured with respect to all ink transfer rollers (15) of all ink transfer roller units (45) respectively. Although it is preferable that the measurement of concentration of ink be performed online, the concentration of ink may be measured offline. In both cases, the acquired concentration values are fed back to the control device of the ink supply device in the order that printings are performed.

The control device (34) of the ink supply device includes: a concentration target value setting means (51); a graph value setting means (52); a concentration prediction value calculation means (53); a graph change value calculation means (54), a controlling graph value calculation means (55); and a switching valve ON/OFF means (56).

The graph value setting means (52) and the switching valve turning ON/OFF means (56) are conventionally known parts. In the graph value setting means (52), graph values for respective colors and for respective ink transfer rollers (15) are set. The switching valve turning ON/OFF means (56) controls an ON time of the switching valve (30) (see FIG. 2 and FIG. 3) based on a graph value.

Conventionally, in the switching valve turning ON/OFF means (56), an ON time of the switching valve (30) is determined based on a graph value Gb stored in the graph value setting means (52) such that a graph value becomes the graph value Gb, and such an ON/OFF signal is outputted to the switching valve (30).

In this embodiment, a graph value Gb stored in the graph value setting means (52) is changed by the controlling graph value calculation means (55), and an ON time of the switching valve (30) in the switching valve turning ON/OFF means (56) is decided based on such a graph value Ga after a change.

The changed graph value Ga is acquired as follows based on a concentration measurement value Xn which is acquired by the concentration measurement device (50).

Figure 5:
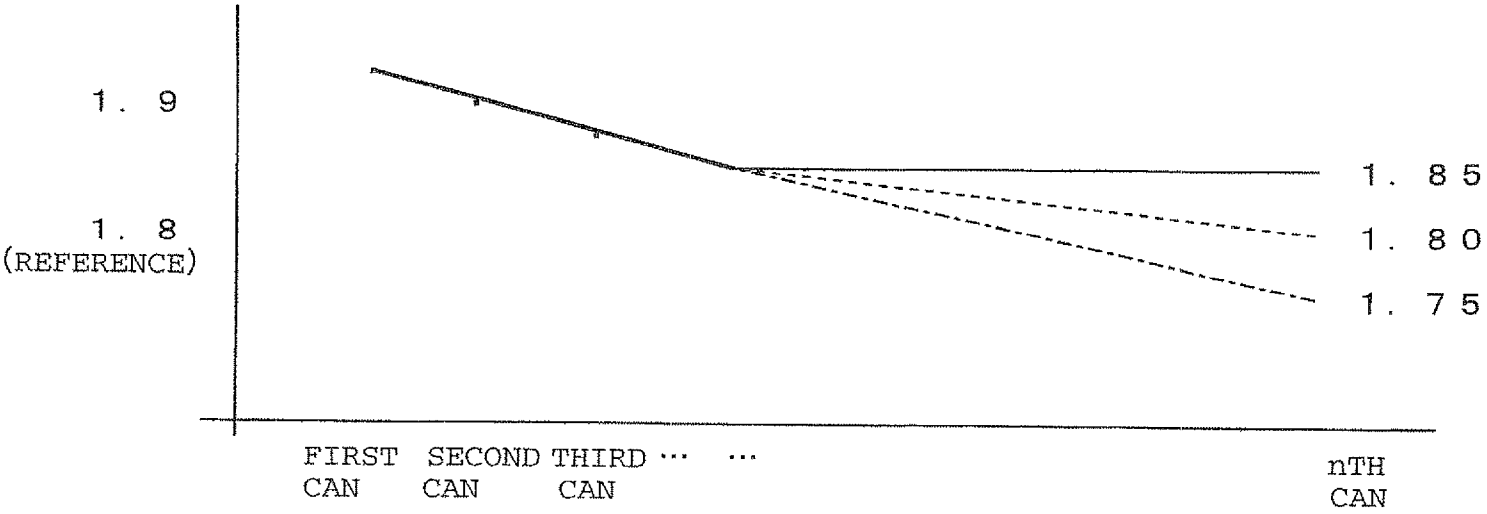
FIG. 5 is a view for explaining an example of a change in concentration.

Firstly, in the concentration prediction value calculation means (53), a concentration prediction value Y is acquired based on a plurality of concentration measurement values. Concentration is changed as shown in FIG. 5, for example. In the example shown in the drawing, the process is shown where the concentration is gradually decreased in the order of the concentration at the first time, the concentration at the second time, and the concentration at the third time is shown. In this stage, it is indefinite whether the concentration is converged to 1.85, 1.80, or 1.75. In the case where a target value is 1.80, when a concentration prediction value Y at n-th time (final) is 1.85, it is sufficient to lower a graph value such that the concentration is lowered, while when a concentration prediction value Y is 1.75, it is sufficient to increase a graph value such that the concentration is increased.

A concentration prediction value is acquired by acquiring one or a plurality of measurement values and by performing calculation using the plurality of measurement values.

When the concentration is measured twice or more (n times), a concentration prediction value is acquired as follows.

Firstly, a standard deviation σ is acquired by using all measurement values ($X_1$, $X_2$, . . . , $X_n$) acquired by measurements performed n times. An average value of the measurement values acquired by measurements performed n times is assumed as Xa.

$$\sigma^2=\{(X_1-X_a)^2+(X_2-X_a)^2+\ldots+(X_n-X_a)^2\}/n$$

Next, based on the standard deviation σ, a deviation value T of a measurement value acquired by the final (n-th) measurement out of the measurements performed n times is calculated.

$$T=\{10\times(X_n-X_a)/\sigma\}$$

By calculating the deviation value T, it is possible to determine the level of the concentration measured by the final (n-th) measurement among all measurement values acquired by the measurements performed n times.

Next, a concentration prediction value Y is calculated using a concentration prediction coefficient α.

$$Y=X_n+T\times|X_n-X_a|\times\alpha$$

Here, when the same measurement value is acquired in the measurements performed n times, the relationship of $Y=X_1=(X_2=X_n)$ is established. Also when the measurement is performed one time, the relationship of $Y=X_1$ is established.

In the graph change value calculation means (54), a graph value is acquired as follows using a concentration prediction value Y.

Assuming a concentration target value (reference value) of ink as K, a ratio L of surplus or shortage of ink is calculated by the following formula.

$$L=(Y-K)\times100/K(\%)$$

Here, a graph change value Gs is calculated using a graph value correction coefficient β. A graph value before a change is assumed as Gb.

The relationship of Gs=Gb×L×β÷100(%) is established.

In the controlling graph value calculation means (55), a changed graph value Ga is acquired by a formula Ga=Gb+Gs. The changed graph value Ga is used as a controlling graph value in place of a pre-set graph value Gb, and an ON time of the switching valve (30) is controlled based on the controlling graph value Ga.

The concentration prediction coefficient α and the graph value correction coefficient β are set to 1 temporarily, for example, and may be set to an empirically proper value. A prediction value can be adjusted by changing a value of α, and a graph change value can be adjusted by changing a value of β. The graph value correction coefficient β may take a different value between the case where the concentration prediction value Y is larger than the concentration target value K and the case where the concentration prediction value Y is smaller than the concentration target value K.

Due to the above-mentioned concentration correction, the concentrations are converged to a target value. There may be a case where convergence takes time so that it takes a long time until the proper concentration is acquired (resulting in the production of a large number of printed matters having inappropriate concentration). In view of the above, in the above-mentioned controlling graph value calculation means (55), before a changed graph value Ga is set, a temporary graph value Gz1 amounting to 1 cycle is outputted by the predetermined number of temporary cycles S.

Figure 6:
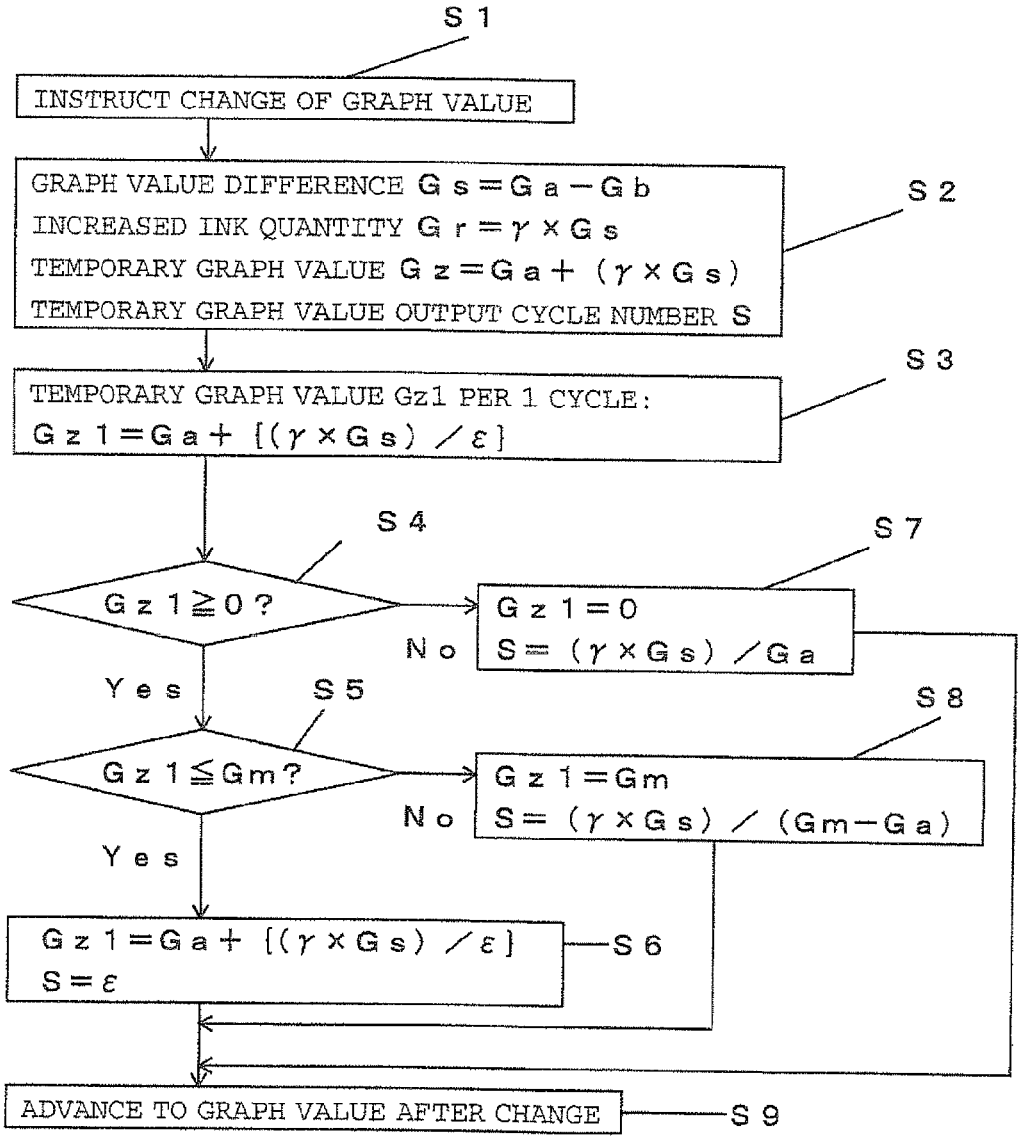
FIG. 6 is a flowchart showing a first essential part of a control in the ink supply device.

FIG. 6 is a flowchart showing an essential part of a control program for outputting a temporary graph value Gz1 amounting to 1 cycle by the predetermined number of temporary cycles S.

As shown in the flowchart in FIG. 6, in performing a control of a change in a graph value, when an instruction for a change of a graph value is inputted (S1), assuming a temporary graph value amounting to 1 cycle as Gz1 and the number of cycles of executing a change in a graph value as S, a graph value difference Gs before and after the change is acquired by a formula Gs=Ga−Gb using a graph value Gb before a change, a graph value Ga after the change, and a concentration correction coefficient γ. A increased ink quantity Gr is acquired using a formula Gr=γ×Gs, and a temporary graph value Gz is acquired using a formula Gz=Ga+Gr=Ga+(γ×Gs) (S2).

Assuming that a graph value Gz1 amounting to 1 cycle is outputted by dividing an increased ink quantity Gr by ϵ cycles, the graph value Gz1 is acquired by a formula Gz1=Ga+{(γ×Gs)/ϵ} (S3).

Gs is expressed as Gs=Ga−Gb and hence, both the case where Ga is smaller than Gb(Ga<Gb) and the case where Ga is larger than Gb(Ga>Gb) are possible. Accordingly, Gz1 takes an either a positive value or a negative value. When Gz1 takes a positive value, a temporary graph value becomes an amplifying graph value, and a temporary graph value amounting to 1 cycle which is a quantity of ink to be supplied amounting to 1 cycle becomes a value larger than Ga. A quantity of ink to be supplied amounting to 1 cycle does not exceed a quantity of ink Gm to be supplied by 1 circumference of the ink transfer roller (15). Accordingly, when Gz1 takes a positive value, it is necessary to distinguish cases depending on whether or not Gz1 exceeds a quantity of ink Gm to be supplied by 1 circumference of the ink transfer roller (15). When Gz1 takes a negative value, the negative supply of a quantity of ink does not exist and hence, a supply quantity of ink is set to 0%, and the number of times of cycles that ink is supplied with a supply quantity of 0% is performed is calculated corresponding to a value of Gz1.

Accordingly, firstly, it is determined whether or not Gz1 is equal to or larger than 0 (Gz1≥0) (S4). When Gz1 is smaller than 0 (Gz1<0), the processing advances to step (S7). When Gz1 is equal to or larger than 0 (Gz1≥0), it is determined whether or not Gz1 is equal to or smaller than Gm (Gz1≤Gm) (S5). Then, when Gz1 is equal to or smaller than Gm (Gz1≤Gm), the temporary graph value Gz1 amounting to 1 cycle is set to the already acquired Gz1 which is expressed as Gz1=Ga+{(γ×Gs)/ϵ}, and this Gz1 is outputted by an amount corresponding to 8 cycles (S6). Due to such processing, step of temporarily amplifying the output is completed and, thereafter, the graph value is shifted to a post-change graph value which is an output similar to an output of a conventional method (S9).

When Gz1 does not satisfy Gz1≤Gm, that is, Gz1 satisfies Gz1>Gm in step S5 where it is determined whether or not Gz1≤Gm is satisfied (S5), Gz1 is set to a quantity of ink Gm to be supplied amounting to 1 circumference of the ink transfer roller (15) which is a maximum quantity capable of supplying the temporary graph value Gz1 amounting to 1 cycle (Gz1=Gm). In this case, an increment (Gm−Ga) of a quantity of ink to be supplied in 1 cycle is expressed as (Gm−Ga), and a quantity of ink necessary for amplification in total is expressed as Gr=γ×Gs. Accordingly, the number of cycles necessary for amplifying is acquired by a formula S=(γ×Gs)/(Gm−Ga) (S8). Due to such processing, step of temporarily amplifying the output is completed and, thereafter, the graph value is shifted to a post-change graph value which is an output similar to an output of a conventional method (S9).

When Gz1 is smaller than 0 (Gz1<0) in step S4 where it is determined whether or not Gz1_Gm is satisfied (S4), in step (S7), the temporary graph value Gz1 amounting to 1 cycle becomes 0 (Gz1=0). In this case, a quantity of ink used (decreased) in 1 cycle is Ga, and a quantity of ink necessary to be decreased in total is expressed by Gr=γ×Gs and hence, the number of times of cycles S necessary for the decrease of a quantity of ink is acquired by S=(γ×Gs)/Ga. Due to such processing, step of temporary amplifying an output (amplifying a decreasing quantity) is completed and, thereafter, the graph value is shifted to a post-change graph value which is an output similar to an output of a conventional method (S9).

In this manner, in the ink supply device of this embodiment, compared to conventional outputting of a temporary graph value in the order of . . . Gb→Ga . . . Ga . . . , a temporary graph value is outputted in the order of . . . Gb→Gz1 . . . Gz1→Ga . . . Ga . . . . Then, by dividing outputting of the temporary graph value into three cases, a temporary graph value Gz1 amounting to 1 cycle and the temporary number of cycles S corresponding to the temporary graph value Gz1 are acquired by the above-mentioned calculation and hence, irrespective of the case where a quantity of ink is increased or the case where a quantity of ink is decreased, the time necessary until the concentration of ink becomes stable when the graph value is changed can be shortened.

In the above-mentioned flowchart, the case where Gz1=0 is included in the case where Gz1≥0, and the case where Gz1=Gm is included in the case where Gz1≤Gm. However, the completely same result (both cases acquiring the same values with respect to Gz1 and S) can be acquired even when the case where Gz1=0 is included in the case where Gz1≤0, and the case where Gz1=Gm is included in the case where Gz1≥Gm.

As described above, in the control device (34), an instruction value of a quantity of ink corresponding to a pattern area is given as a graph value for every ink transfer roller, the concentration of ink on the ink transfer roller is increased by elevating a graph value of a predetermined ink transfer roller, and the concentration of ink on the ink transfer roller is decreased by lowering the graph value of the predetermined ink transfer roller.

Although each graph value is changed usually when an original plate is exchanged, by outputting a new instruction value, ink can acquire the concentration corresponding to the instruction value finally and hence, a particular control has not been performed immediately after the exchange of the original plate conventionally.

The control device of the ink supply device according to this embodiment is additionally provided with a control program of a concentration instruction value immediately after exchanging an original plate which has not been provided to a control device of a conventional ink supply device. An essential part of the program is described in a flowchart shown in FIG. 7.

Figure 7:
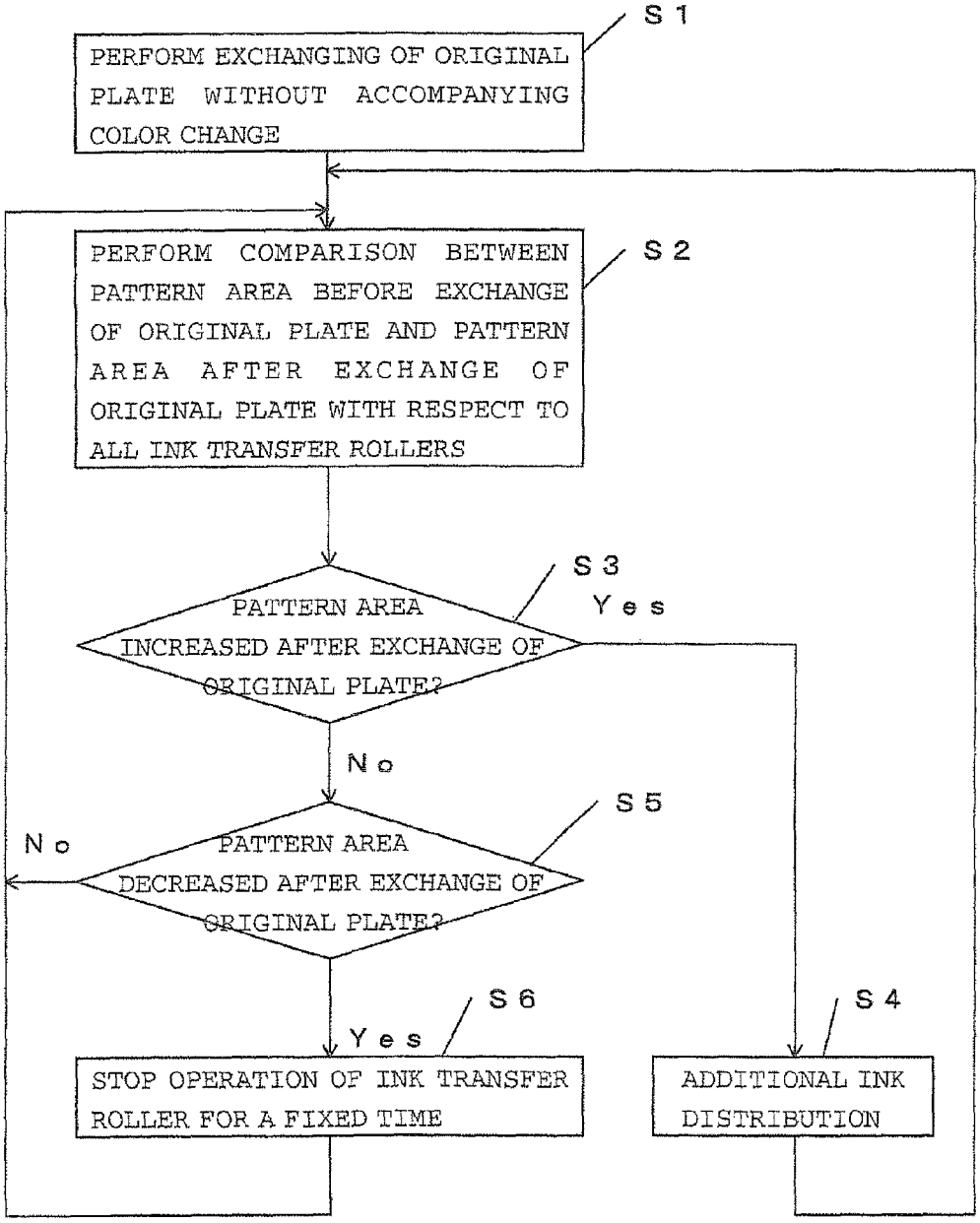
FIG. 7 is a flowchart showing a second essential part of the control in the ink supply device.

As described in the flowchart shown in FIG. 7, in performing the control of the concentration instruction value immediately after the exchange of the original plate, at the time of performing the exchange of the original plate with no color change (S1), a comparison of a pattern area before the exchange of the original plate and a pattern area after the exchange of the original plate is performed with respect to all ink transfer rollers (S2). When the pattern area after the exchange of the original plate is increased (S3), additional ink distribution (S4) is performed, while when the pattern area before the exchange of the original plate is decreased (S6), an operation of the ink transfer roller is stopped for a fixed time (S6).

Ink retained in the ink transfer roller at the time of stable printing is, assuming that the ink is ink having a uniform thickness over a whole region from one edge to the other edge of the ink transfer roller (referring to as Y), considered to be in a state where ink having a thickness proportional to a pattern area of a printed matter (setting a proportional constant to Y) overlaps with the ink transfer roller. Accordingly, assuming a pattern area before the exchange of the original plate as A %, a quantity of ink (%) retained before the exchange of the original plate becomes Y+AZ (%), while assuming a pattern area after the exchange of the original plate as B %, a quantity of ink (%) retained after the exchange of the original plate becomes Y+BZ (%). The difference before and after the exchange of the original plate becomes (B−A)Z (%).

There are the case where B>A and the case where B<A and hence, the difference takes a positive value or a negative value. A different operation is performed depending on whether the difference is a positive value or a negative value.

Firstly, in the case where the difference is expressed as (B−A)Z>0, a pattern area (required quantity of ink) after the exchange of the original plate is large and hence, ink is insufficient. This implies that additional ink distribution is necessary. For example, when the pattern area is changed from 30% to 40%, with outputting of an instruction which sets the pattern area to 40%, an actual quantity of ink becomes 30%+a. However, it takes long time until the quantity of ink arrives at 40%. In view of the above, additional ink distribution is performed where the number of times of ink distribution is set to Z times which is the proportional number of times. A percentage of ink distribution becomes (B−A) (%). According to such a control, contrary to a conventional method where the concentration of ink arrives at the concentration of a new instruction value after being gradually increased, in the invention, the concentration of ink is rapidly increased and arrives at a value in the vicinity of an instruction value and, thereafter, the concentration of ink arrives at the concentration of the instruction value and hence, the printing concentration can be made stable.

On the other hand, in the case where the difference is expressed as (B−A) Z<0, this implies that ink is in a surplus state. For example, when the pattern area is changed from 40% to 30%, with outputting of an instruction which sets the pattern area to 30%, an actual quantity of ink becomes 40%−α. However, it takes long time until the quantity of ink arrives at 30%. In view of the above, ink transfer is stopped for a predetermined time. The condition for stopping the ink transfer is that the ink transfer amounting to (A-B) Z/B times is stopped. According to such a control, contrary to a conventional method where the concentration of ink arrives at the concentration of a new instruction value after being gradually decreased, a concentration decreased quantity is largely increased and hence, the concentration of ink arrives at the concentration of an instruction value within a short time whereby printing concentration can be made stable.

As described above, according to the ink supply device of this embodiment, in performing the exchange of the original plate, a pattern area before the exchange of the original plate is set to A %, a quantity of retained ink (%) before the exchange of the original plate is set to Y+AZ, a pattern area after the exchange of the original plate is set to B %, a quantity of retained ink (%) after the exchange of the original plate is set to Y+BZ, and corresponding to whether the difference (B−A)Z (%) before and after the exchange of the original plate is positive or negative, additional ink distribution is performed Z times in the case where (B−A) Z>0, and the ink transfer is stopped the number of times amounting to (A−B)Z/B times in the case (B−A)Z<0. Due to such a control, in both the case where (B−A)Z>0 and the case where (B−A)Z<0, the concentration of ink arrives at the concentration of an instruction value after the exchange of the original plate within a short time and hence, printing concentration can be made stable.

In performing the above-mentioned ink supply, when a quantity of required ink is small, in place of a normal operation where the transfer of ink is performed every time for every transfer timing, an intermittent operation where the number of times of transfer is decreased compared to the normal operation is performed.

In performing the intermittent operation, when a control contact length corresponding to a quantity of required ink is less than a controllable minimum contact length, the number of times of transfer is decreased compared to the case where the transfer of ink is performed every time for every transfer timing and hence, an average value of the control contact length is controlled to a control contact length corresponding to a required quantity of ink.

When B is equal to or less than the intermediate operation percentage and B satisfies (B−A) Z<0 at the time of performing the intermittent operation, it is preferable to stop the ink transfer amounting to {(A−B)Z/B}×C/B times. That is, when B is equal to or less than intermittent operation percentage and satisfies (B−A)Z<0, ink cannot be consumed sufficiently when the stopping of ink transfer is performed the number of times amounting to (A−B)Z/B times and hence, the number of times that the ink transfer is stopped is increased by an amount corresponding to the C/B.

Due to such a control, even when the intermittent operation is performed, the concentration of ink arrives at the concentration of an instruction value after the exchange of the original plate within a short time and hence, printing concentration can be made stable.

In the above-mentioned constitution, the constitution of the ink supply device for a printing machine and the method of controlling a quantity of ink are not limited to the corresponding constitution and the control method of the embodiment described above, and can be suitably modified. A printed matter may be paper, a can or the like.

INDUSTRIAL APPLICABILITY

According to the ink supply device for a printing machine according to the invention, a quantity of ink necessary for acquiring desired concentration can be accurately supplied without requiring the fine adjustment of the concentration by an operator and hence, the invention contributes to the enhancement of printing accuracy and saving on manpower in operating the printing machine.

The invention claimed is:

1. An ink supply device of a printing machine, said ink supply device comprising:

an ink fountain roller that constitutes an ink fountain;

a plurality of ink transfer rollers that are divided in the lengthwise direction of the ink fountain roller and are arranged adjacent to the ink fountain roller;

a switching device that individually changes over the respective ink transfer rollers between a transfer position where the ink transfer roller is brought into contact with the ink fountain roller and a non-transfer position where the ink transfer roller is disposed away from the ink fountain roller; and a control device programmed to control supply of a quantity of ink, wherein, based on a graph value set corresponding to a pattern area of a printed matter, a circumferential length of ink transferred to the ink transfer roller from the ink fountain roller is controlled by changing over an energy state of a switching valve of the switching device by the control device, wherein the control device comprises:

a concentration prediction value calculation means that acquires a concentration prediction value when the concentration becomes stable based on concentration measured values of a predetermined number of printed matters;

a graph change value calculation means that acquires a graph change value using the concentration prediction value and a concentration target value;

a control graph value calculation means that acquires a control graph value for controlling a rotational angle of the required ink fountain roller based on a preset set graph value and the graph change value; and a switching valve turning ON/OFF means that controls an ON/OFF time of the switching valve, wherein the concentration prediction value calculation means acquires a prediction value Y at a point of time that the measurement is performed n times by the following formulae, where with a measurement value at n-th time being Xn, an average value of measurement values of n times being Xa, a standard deviation amounting to n times being σ, a deviation value of a measurement value at n-th time being T, and a concentration prediction coefficient being α:

$$Y=Xn+\{T\times|Xn-Xa|\times\alpha\};$$

$$T=\{10\times(Xn-Xa)/\sigma\}; \text{ and}$$

$$\sigma^2=\{(X_1-Xa)^2+(X_2-Xa)^2+\ldots+(Xn-Xa)^2\}/n,$$

wherein, in the above formulae, when n=1 and when the same measurement value is acquired in all measurements performed n times, the graph change value calculation means acquires a graph change value Gs by the following formulae, where with a concentration target value being K, a preset graph value being Gb, a ratio of surplus/shortage of ink being L, and a graph value correction coefficient being β:

$$Y=Xn;$$

$$L=(Y-K)\times 100/K(\%); \text{ and}$$

$$Gs=Gb\times L\times\beta+100(\%), \text{ and}$$

wherein the control graph value calculation means acquires the control graph value Ga by the following formula:

$$Ga=Gb+Gs.$$

2. The ink supply device of a printing machine according to claim 1, wherein at the time of changing the graph value to the control graph value Ga from preset graph value Gb (Gs=Ga−Gb), the control graph value calculation means outputs Gz1=Ga+{(γ×Gs)/ϵ}, where γ and ϵ are concentration correction coefficients of natural numbers, by an amount corresponding to E cycles as the control graph value to the switching valve turning ON/OFF means when Gz1 is equal to or smaller than Gm, wherein the control graph value calculation means outputs Gm by an amount corresponding to S cycles, S=(γ×Gs)/(Gm−Ga), as the control graph value to the switching valve turning ON/OFF means when Gz1 satisfies Gz1>Gm, and wherein the control graph value calculation means outputs 0 by an amount corresponding to S cycles, S=(γ×Gs)/Ga, as the control graph value to the switching valve turning ON/OFF means when Gz1<0.

3. The ink supply device of a printing machine according to claim 1, wherein at the time of exchanging an original plate, a comparison between a pattern area before exchanging the original plate and a pattern area after the exchange of the original plate is performed with respect to all ink transfer rollers, wherein, when the pattern area is increased after the exchange of the original plate, additional ink distribution is performed, wherein, when the pattern area is decreased after the exchanging the original plate, an operation of the ink transfer roller is stopped for a fixed time, and wherein, assuming that the pattern area before exchanging the original plate is A (%), a retention ink quantity (%) before exchanging the original plate is Y+AZ (%), the pattern area after the exchange of the original plate is B (%), a retention ink quantity (%) after the exchange of the original plate is Y+BZ (%), the following operations are performed corresponding to whether the difference (B−A)Z (%) before and after the exchange of the original plate takes a positive value or a negative value:

the switching valve turning ON/OFF means outputs ON/OFF signals so that additional ink distribution is performed Z times in case of (B−A)Z>0; and the switching valve turning ON/OFF means outputs ON/OFF signals so that ink transfer amounting to (A−B)Z/B times is stopped in case of (B−A)Z<0.

4. The ink supply device of a printing machine according to claim 3, wherein when a normal operation where the transfer of ink is performed each time for every transfer timing and an intermittent operation where the number of times of transfer is decreased compared to the normal operation are performed, and B is equal to or less than an intermittent operation percentage and satisfies (B−A)Z<0, the switching valve turning ON/OFF means outputs ON/OFF signals so that ink transfer amounting to {(A−B)Z/B}×C/B times is stopped.

5. An ink supply device of a printing machine, said ink supply device comprising:

an ink fountain roller that constitutes an ink fountain;

a plurality of ink transfer rollers that are divided in the lengthwise direction of the ink fountain roller and are arranged adjacent to the ink fountain roller;

a switching device that individually changes over the respective ink transfer rollers between a transfer position where the ink transfer roller is brought into contact with the ink fountain roller and a non-transfer position where the ink transfer roller is disposed away from the ink fountain roller; and a control device programmed to control supply of a quantity of ink, wherein, based on a graph value set corresponding to a pattern area of a printed matter, a circumferential length of ink transferred to the ink transfer roller from the ink fountain roller is controlled by changing over an energy state of a switching valve of the switching device by the control device, wherein the control device comprises:

a concentration prediction value calculation means that acquires a concentration prediction value when the concentration becomes stable based on concentration measured values of a predetermined number of printed matters;

a graph change value calculation means that acquires a graph change value using the concentration prediction value and a concentration target value;

a control graph value calculation means that acquires a control graph value for controlling a rotational angle of the required ink fountain roller based on a preset set graph value and the graph change value; and a switching valve turning ON/OFF means that controls an ON/OFF time of the switching valve, and wherein, at the time the graph value is changed to a control value Ga from a set value Gb in the control graph value calculation means, the switching valve turning ON/OFF means changes an ON time of the switching valve longer so that an ink quantity equal to or larger than the difference is rapidly supplied for a fixed time in case of increasing the ink quantity, and the switching valve turning ON/OFF means changes an OFF time of the switching valve longer so that an outputting of the ink transfer roller is stopped for a fixed time in case of decreasing the ink quantity.

6. The ink supply device of a printing machine according to claim 5, wherein the control graph value calculation means outputs $Gz1=Ga+\{(\gamma\times Gs)/\epsilon\}$, where $\gamma$ and $\epsilon$ are concentration correction coefficients of natural numbers, by an amount corresponding to $\epsilon$ cycles as the control graph value to the switching valve turning ON/OFF means when Gz1 is equal to or smaller than Gm, wherein the control graph value calculation means outputs Gm by an amount corresponding to S cycles, $S=(\gamma\times Gs)/(Gm-Ga)$, as the control graph value to the switching valve turning ON/OFF means when $Gz1>Gm$, and wherein the control graph value calculation means outputs 0 by an amount corresponding to S cycles, $S=(\gamma\times Gs)/Ga$, as the control graph value to the switching valve turning ON/OFF means when $Gz1<0$.

7. An ink supply device of a printing machine, said ink supply device comprising:

an ink fountain roller that constitutes an ink fountain;

a plurality of ink transfer rollers that are divided in the lengthwise direction of the ink fountain roller and are arranged adjacent to the ink fountain roller;

a switching device that individually changes over the respective ink transfer rollers between a transfer position where the ink transfer roller is brought into contact with the ink fountain roller and a non-transfer position where the ink transfer roller is disposed away from the ink fountain roller; and a control device programmed to control supply of a quantity of ink, wherein, based on a graph value set corresponding to a pattern area of a printed matter, a circumferential length of ink transferred to the ink transfer roller from the ink fountain roller is controlled by changing over an energy state of a switching valve of the switching device by the control device, wherein the control device comprises:

a concentration prediction value calculation means that acquires a concentration prediction value when the concentration becomes stable based on concentration measured values of a predetermined number of printed matters;

a graph change value calculation means that acquires a graph change value using the concentration prediction value and a concentration target value;

a control graph value calculation means that acquires a control graph value for controlling a rotational angle of the required ink fountain roller based on a preset set graph value and the graph change value; and a switching valve turning ON/OFF means that controls an ON/OFF time of the switching valve, wherein at the time of exchanging an original plate, a comparison between a pattern area before exchanging the original plate and a pattern area after the exchange of the original plate is performed with respect to all ink transfer rollers, wherein, when the pattern area is increased after the exchange of the original plate, additional ink distribution is performed, wherein, when the pattern area is decreased after the exchanging the original plate, an operation of the ink transfer roller is stopped for a fixed time, and wherein, assuming that the pattern area before exchanging the original plate is A (%), a retention ink quantity (%) before exchanging the original plate is Y+AZ (%), the pattern area after the exchange of the original plate is B (%), a retention ink quantity (%) after the exchange of the original plate is Y+BZ (%), the following operations are performed corresponding to whether the difference (B−A)Z (%) before and after the exchange of the original plate takes a positive value or a negative value:

the switching valve turning ON/OFF means outputs ON/OFF signals so that additional ink distribution is performed Z times in case of $(B-A)Z>0$; and the switching valve turning ON/OFF means outputs ON/OFF signals so that ink transfer amounting to (A−B)Z/B times is stopped in case of $(B-A)Z<0$.

8. The ink supply device of a printing machine according to claim 7, wherein when a normal operation where the transfer of ink is performed each time for every transfer timing and an intermittent operation where the number of times of transfer is decreased compared to the normal operation are performed, and B is equal to or less than an intermittent operation percentage and satisfies $(B-A)Z<0$, the switching valve turning ON/OFF means outputs ON/OFF signals so that ink transfer amounting to $\{(A-B)Z/B\}\times C/B$ times is stopped.

* * * * *